US010676930B2

(12) United States Patent
West

(10) Patent No.: US 10,676,930 B2
(45) Date of Patent: Jun. 9, 2020

(54) DRAIN RETROFIT AND METHOD

(71) Applicant: HENRY WDG, LLC, El Segundo, CA (US)

(72) Inventor: Richard A. West, Lakewood, OH (US)

(73) Assignee: HENRY WDG, LLC, El Sugundo, CA (US)

( * ) Notice: Subject to any disclaimer, the term of this patent is extended or adjusted under 35 U.S.C. 154(b) by 633 days.

(21) Appl. No.: 15/509,756

(22) PCT Filed: Sep. 9, 2015

(86) PCT No.: PCT/US2015/049146
§ 371 (c)(1),
(2) Date: Mar. 8, 2017

(87) PCT Pub. No.: WO2016/040454
PCT Pub. Date: Mar. 17, 2016

(65) Prior Publication Data

US 2017/0247886 A1 Aug. 31, 2017

Related U.S. Application Data

(60) Provisional application No. 62/047,776, filed on Sep. 9, 2014.

(51) Int. Cl.
*E04D 13/04* (2006.01)

(52) U.S. Cl.
CPC .. *E04D 13/0409* (2013.01); *E04D 2013/0413* (2013.01); *E04D 2013/0436* (2013.01)

(58) Field of Classification Search
CPC ..... E04D 13/0409; E04D 2013/0413; E04D 2013/0436; E04D 13/0404
See application file for complete search history.

(56) References Cited

U.S. PATENT DOCUMENTS 1,805,816 A * 5/1931 Fleming ..... E04D 13/0409 285/42
3,893,919 A * 7/1975 Flegel ..... E04D 13/0409 210/166

(Continued)

FOREIGN PATENT DOCUMENTS

DE 1658207 B1 * 1/1970 ..... E04D 13/0409
DE 2407546 A1 * 8/1975 ..... E03F 5/0407

OTHER PUBLICATIONS

Dura Retrofit Drain, Marathon Roofing Products, Inc. 2012 (retrieved by Examiner from internet on Nov. 23, 2015: https://web.archive.org/web/2012023074909/http/www.marathondrains.com/our-products/product:dura/)—and again by applicant on Jan. 5, 2016.

(Continued)

*Primary Examiner* — James M Hewitt, II
(74) *Attorney, Agent, or Firm* — Fay Sharpe LLP

(57) ABSTRACT

A drain insert assembly is provided for retrofitting or for use with an existing drain bowl received in a roof surface that interconnects with a drain pipe. The drain insert assembly includes a drain insert configured to extend between the roof and the existing drain pipe. The drain insert includes a first, end portion dimensioned for receipt in the existing drain pipe, and a second portion dimensioned to cover an inner surface of the existing drain bowl, and at least one flange extending outwardly from the end portion. An uncured seal material is interposed between the end portion and the existing drain pipe.

20 Claims, 2 Drawing Sheets

(56) References Cited

U.S. PATENT DOCUMENTS

| | | | | |
|---|---|---|---|---|
| 4,505,499 | A | 3/1985 | Uglow et al. | |
| 4,759,163 | A | 7/1988 | Mason et al. | |
| 5,724,777 | A | 3/1998 | Hubbard | |
| 6,168,208 | B1 | 1/2001 | Thaler | |
| 6,318,397 | B1 * | 11/2001 | Huber | E03F 5/0407 137/15.19 |
| 2003/0037498 | A1 * | 2/2003 | Bishop | E04D 13/0409 52/302.1 |

OTHER PUBLICATIONS

PCT/US2015/049146, International Search Report and Written Opinion, dated Dec. 18, 2015.

* cited by examiner

DRAIN RETROFIT AND METHOD

This application claims the priority benefit of U.S. provisional application Ser. No. 62/047,776, filed Sep. 9, 2014, the entire disclosure of which is expressly incorporated herein by reference.

BACKGROUND

The present disclosure relates to a retrofit assembly, and more particularly to a drain retrofit assembly for use with an existing roof drain assembly. The disclosure may find application in related environments and applications that encounter similar issues.

There are known, commercially available drain inserts (see, for example, U.S. Pat. No. 6,647,682) for retrofitting existing roof drain systems. One of these drain inserts, for example, is a product manufactured by Marathon Co. With that product, the new (aluminum) drain is inserted into the old drain pipe and a rubber gasket is expanded at the bottom of the inserted new drain to make a water tight seal with the existing drain pipe.

A need exists for an alternative retrofit structure and method of retrofitting an existing drain assembly, such as used on commercial roofs.

SUMMARY

A drain insert assembly is provided for retrofitting or for use with an associated drain bowl received in an associated surface that interconnects with an associated drain pipe.

The drain insert assembly includes a drain insert configured to extend between the associated surface and the associated drain pipe. The drain insert includes a first, end portion dimensioned for receipt in the associated drain pipe, and a second portion dimensioned to cover an inner surface of the associated drain bowl, and at least one flange extending outwardly from the end portion.

An uncured seal material is interposed between the end portion and the associated drain pipe.

The drain insert includes multiple flanges or wings extending outwardly from the end portion for sealing engagement with the associated drain pipe.

Each of the multiple flanges extends outwardly from the end portion at an angle toward the second portion.

At least one of the multiple flanges extends continuously about a perimeter of the end portion.

The at least one flange has a first dimension without any load imposed thereon that is greater than the associated drain pipe and a reduced, second dimension when inserted into the associated drain pipe.

The second portion has a mating, generally hemispherical contour or bowl-shape for covering receipt of the associated drain bowl.

The drain insert assembly includes a planar perimeter portion surrounding the second portion for receipt over the associated surface.

The drain insert assembly further includes a drain cover attachment mechanism.

The at least one flange has a varying cross-sectional conformation that has a greater dimension where the flange interconnects with the end portion and a lesser dimension at an outer terminal end thereof.

The end portion further includes an inwardly extending shoulder, and the assembly further includes a setting tool dimensioned for receipt through the second portion and into the end portion such that the setting tool engages the shoulder to advance the end portion into the associated drain pipe.

The drain insert is preferably a silicone material and the seal material is preferably a uncured, silicone caulk-like material.

A method of retrofitting an existing roof that includes a drain bowl that communicates with a drain pipe with a drain insert assembly that includes a first, end portion, at least one flange extending outwardly from the end portion, a second portion dimensioned to cover an inner surface of the drain bowl, and a seal material interposed between at least the end portion and the drain pipe is provided.

The method includes providing the seal material around at least the end portion and the at least one flange, and inserting the end portion into the drain pipe until the second portion is received in the drain bowl.

The end portion inserting step includes deforming the at least one flange between the end portion and the drain pipe.

The seal material providing step includes adding seal material between the second portion of the drain insert assembly and the inner surface of the drain bowl.

The end portion inserting step includes collapsing the at least one flange to release the seal material held therein toward the second portion.

The method further includes curing the seal material for a preselected time period.

A primary advantage of the subject disclosure is the ease with which an existing drain can be retrofit.

Another benefit is the ability to use an all-silicone drain insert assembly.

Still another advantage resides in the ease with which the drain insert assembly conforms to an existing drain pipe, associated roof structure, and connects with the drain cover.

Yet another benefit is associated with using a curable seal material that is advantageously dispersed between the drain the insert assembly and the existing drain bowl and drain pipe.

Still other benefits and advantages of the present disclosure will become more apparent from reading and understanding the following detailed description.

DETAILED DESCRIPTION

Figure 1:
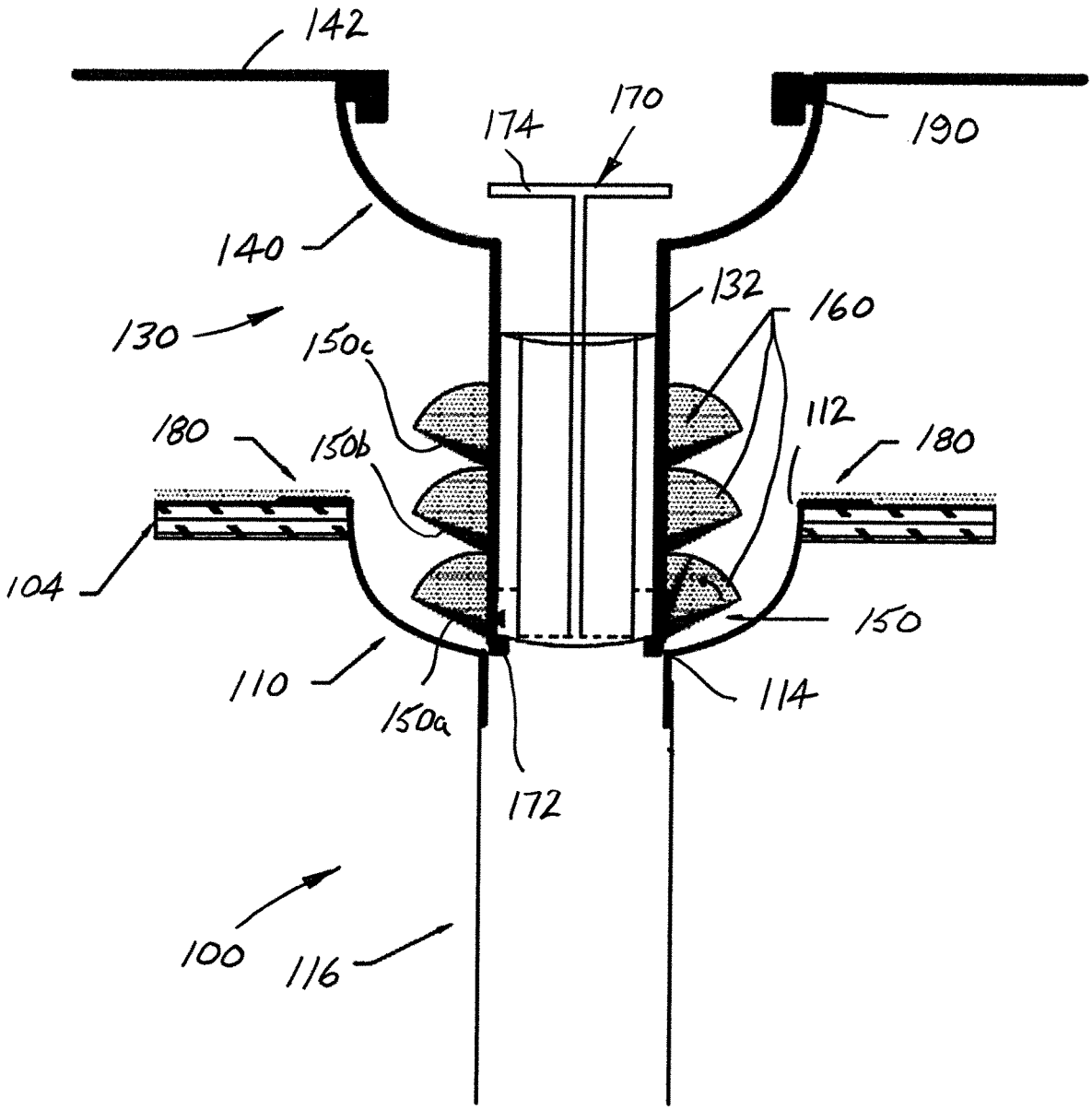
FIG. 1 is an elevational view shown partially in cross-section of the drain insert assembly of the present disclosure.
Figure 2:
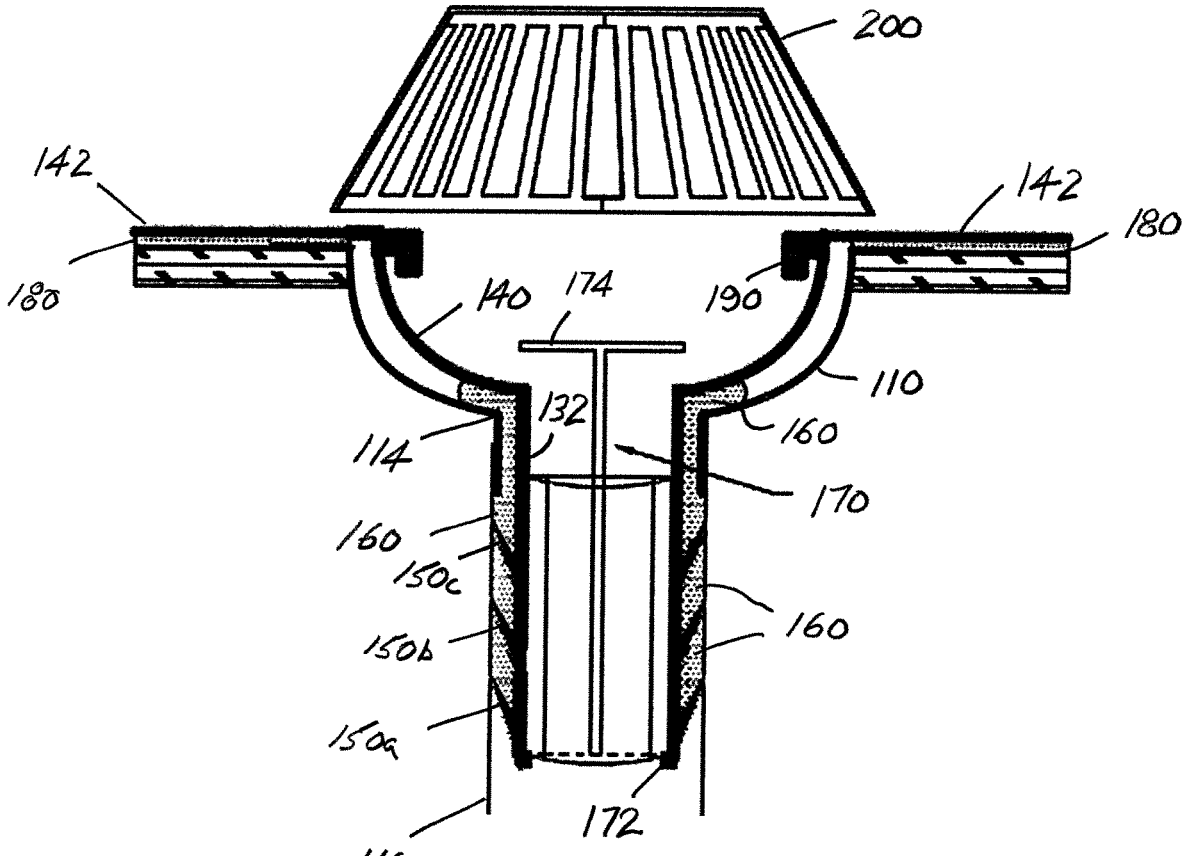
FIG. 2 is an elevational view shown partially in cross-section of the drain insert assembly fully installed in a pre-existing proof drain.

Turning to FIGS. 1 and 2, there is illustrated an existing internal drain assembly WO on a roof. The roof is represented by a surface 104, such as an existing underlayrnent as is commonly used in a commercial roof. The existing drain assembly 100 includes a drain bowl 110 having a generally hemispherical or bowl shape where an upper open edge 112 thereof is generally flush with the surface 104 of the roof. An opening 114 is provided in a lower portion of the drain bowl 110 and the opening communicates with a drain pipe 116. For example, when reroofing, it is common to retrofit the existing drain assembly 100. Typically, portions of the drain assembly have corroded or rusted, and one or more portions of the existing drain assembly may have been damaged or worn over time.

The present disclosure or drain insert assembly 130 shown in FIGS. 1 and 2 is preferably made entirely of a flexible material such as silicone although other flexible materials may be used without departing from the scope and intent of the present disclosure. More particularly, the drain insert assembly 130 includes a first, end portion 132 shown here as a generally hollow structure such as an elongated cylinder having an outer dimension or diameter that easily fits within the existing drain pipe 116. The end portion 132 has a sufficient axial length that allows it to be inserted a predetermined dimension into the existing drain pipe 116.

At the other end of the drain insert assembly 130 is provided a second 140 portion that also has a generally hemispherical or bowl-shape contour for mating, fitting engagement with the existing drain bowl 110. In addition, a planar perimeter portion 142 surrounds an upper perimeter region of the second portion 140 for receipt over the associated roof surface 104. The planar perimeter portion 142 is dimensioned to provide a sufficient coverage area or overlap with the roof around the outer perimeter of the existing drain bowl 110.

At least one flange or wing 150 is provided on the first portion 132. In a preferred arrangement, plural axially spaced flanges 150*a*-150*c* extend outwardly from the perimeter of the first portion 132. More specifically, each flange 150 is integrally formed with the first portion 132 and extends radially outward therefrom. Each flange 150 has a varying thickness, that is preferably greatest where the flange joins to the outer perimeter of the first portion 132 and reduces in cross-sectional dimension, i.e. thins or tapers, to a smaller dimension at an outer terminal edge. Each flange 150 is angled upwardly toward the second portion 140 as the flange proceeds outwardly from the outer perimeter of the first portion toward the terminal edge. Further, each flange 150 has an outer dimension or diameter greater than that of the inner diameter of the existing drain pipe 116. Thus, as the drain insert assembly is inserted through the existing drain bowl 110 and into the drain pipe 116, the individual flanges 150*a-c* are compressed when inserted into the drain pipe to form a sealing interfit with the inner surface of the drain pipe.

An uncured seal material 160 is received in each flange 150 prior to insertion of the first portion 132 into the drain pipe. As the individual flanges are compressed, the uncured seal material 160 is squeezed upwardly (i.e., in a direction from the first portion 132 toward the second portion 140) and outwardly (toward the inner surface of the existing drain pipe 116) to seal along the inner surface of the drain pipe 116. In addition, the seal material also partially extends into a cavity formed between the second portion 140 and the existing drain bowl 110. As will be appreciated, the uncured seal material 160 has a viscosity that allows the seal material to flow as described and will cure over time, e.g. 24 hours. Once cured, the seal material 160 provides a compliant seal that fills the void between the existing drain assembly 100 and that of the drain insert assembly 130 of the present disclosure.

To facilitate insertion of the drain insert assembly 130, a setting tool 170 is received within the drain insert assembly. An inwardly extending shoulder 172 is provided adjacent a terminal end of the first portion 132 of the drain insert assembly 130. The shoulder 172 is suitably dimensioned so that the setting tool 170 abuttingly engages the shoulder and is used to advance the drain insert assembly 130 into the existing drain pipe 116. A handle 174 may be provided at the opposite end of the tool 170 to facilitate manipulation. Again, as the tool 170 advances the drain insert assembly 130 axially inward into the drain pipe 116, the flanges 150 deform or are compressed upwardly and thereby push the uncured seal material 160 outwardly therefrom and fill the voids between the drain insert assembly and the existing drain assembly 100. The tool 170 can be left in place while the uncured seal material 160 cures over time and the tool is then removed, i.e. axially retracted, from the drain insert assembly 130 which is now adhered to the existing drain assembly 100.

In addition, a bead 180 of the uncured seal material 160 may also be placed on the surface 104 of the existing roof around the perimeter of the drain bowl 110. In this manner, as the retrofit or drain insert assembly 130 is advanced into place, an undersurface of the planar perimeter portion 142 is sealed to the roof by the bead 180 of seal material 160.

Further, a drain cover attachment mechanism 190 may be provided on the second portion 140 of the drain insert assembly 130, particularly shown here as adjacent the planar perimeter portion 142 at a region inside the bowl-shaped second portion. The attachment mechanism 190 may adopt a wide variety of configurations to receive a fastener and/or otherwise attach a drain cover 200 (FIG. 2) over the retrofit drain bowl and drain pipe assembly.

In summary, rather than having a rubber gasket seal against the existing drain pipe 116, the silicone drain retrofit or insert 130 of FIGS. 1 and 2 has "flexible wings" 150 that are filled with uncured silicone seal material 116. The insert 130 is slightly smaller in diameter than the existing drain pipe 116 and when the insert is forced into the existing drain pipe (FIG. 2) the silicone wings 150 collapse forcing the uncured silicone seal material 160 around the wings and upward (FIG. 1). Upon cure, the seal material 160 creates a positive seal between the existing drain pipe 116 and the new insert 130.

The tool 170 (or a pipe) is inserted into the new silicone insert 130 to keep the silicone insert 130 firm while sliding it into the existing pipe. This tool/pipe 170 is removed after the seal material 160 has cured, e.g., approximately 24 hours after installation or after the seal material cures.

One desired material of construction is a polymer such as silicone, although other materials could be used, Silicone is desirable because of its inherent properties such as thermal stability (−50 C to over 100 C)/non-reactive in an external environment, sealing capabilities (sealable against water intrusion), ability to adhere to other materials, ultraviolet (UV) light resistance, easy to manufacture, and can be molded to shape so that when used with a silicone sealant having caulk-like qualities, etc., the drain assembly 130 and sealant 160 provide an effective retrofit to an existing drain bowl 110 and drain pipe assembly 100 in a flat roof that addresses the same requirements of the original drain bowl/drain pipe assembly of the roof, and eliminates potential leak paths while being easily installed or retrofitted to the existing structure.

This written description uses examples to describe the disclosure, including the best mode, and also to enable any person skilled in the art to make and use the disclosure. The patentable scope of the disclosure is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. Moreover, this disclosure is intended to seek protection for a combination of components and/or steps and a combination of claims as originally presented for examination, as well as seek potential protection for other combinations of components and/or steps and combinations of claims during prosecution.

It is claimed:

1. A drain insert assembly for use with an associated drain bowl received in an associated surface that interconnects with an associated drain pipe, the drain insert assembly comprising:

a drain insert configured to extend between an associated surface and an associated drain pipe, the drain insert including a first, end portion dimensioned for receipt in the associated drain pipe, and a second portion dimensioned to cover an inner surface of an associated drain bowl, and at least one flange extending outwardly from the end portion; and a seal material interposed between the end portion and an associated drain pipe, the seal material positioned between the second portion of the drain insert assembly and an associated inner surface of an associated drain bowl such that collapsing the at least one flange releases the seal material held therein toward the second portion.

2. The drain insert assembly of claim 1 wherein the drain insert includes multiple flanges extending outwardly from the end portion for sealing engagement with an associated drain pipe.

3. The drain insert assembly of claim 2 wherein each of the multiple flanges extends outwardly from the end portion at an angle toward the second portion.

4. The drain insert assembly of claim 2 wherein at least one of the multiple flanges extends continuously about a perimeter of the end portion.

5. The drain insert assembly of claim 1 wherein the at least one flange has a first dimension without any load imposed thereon that is greater than an associated drain pipe and a reduced, second dimension when inserted into an associated drain pipe.

6. The drain insert assembly of claim 1 wherein the second portion has a generally hemispherical contour for covering receipt of an associated drain bowl.

7. The drain insert assembly of claim 6 further comprising a planar perimeter portion surrounding the second portion for receipt over an associated surface.

8. The drain insert assembly of claim 7 further comprising a drain cover attachment mechanism.

9. The drain insert assembly of claim 1 wherein the at least one flange has a varying cross-sectional conformation that has a greater dimension where the flange interconnects with the end portion and a lesser dimension at an outer terminal end thereof.

10. The drain insert assembly of claim 1 further comprising an inwardly extending shoulder in the end portion, and a setting tool dimensioned for receipt through the second portion and into the end portion such that the setting tool engages the shoulder to advance the end portion into an associated drain pipe.

11. The drain insert assembly of claim 1 wherein the seal material is a silicone material.

12. A drain insert assembly for use with an associated drain bowl received in an associated roof surface that interconnects with an associated drain pipe, the drain insert assembly comprising:

a one-piece drain insert configured to extend between an associated roof surface and associated drain pipe, the drain insert including a first, end portion dimensioned for receipt in an associated drain pipe, and a second portion dimensioned to cover an inner surface of an associated drain bowl, and at least one flange extending outwardly from the end portion; and a seal material interposed between the end portion and an associated drain pipe, the seal material positioned between the second portion of the drain insert assembly and an associated inner surface of an associated drain bowl such that collapsing the at least one flange releases the seal material held therein toward the second portion.

13. The drain insert assembly of claim 12 wherein the drain insert is a silicone material.

14. The drain insert assembly of claim 12 wherein the at least one flange includes first and second flanges extending from an outer surface of the first portion in spaced relation to one another.

15. The drain insert assembly of claim 14 wherein the first and second flanges reduce in thickness as the flanges extend away from an interconnecting region with a perimeter of the end portion toward terminal edges thereof.

16. The drain insert assembly of claim 12 further comprising a drain cover attachment mechanism in the second portion and an inwardly extending shoulder adjacent a terminal end in the end portion, and a setting tool dimensioned for receipt through the second portion and into the end portion such that the setting tool engages the shoulder to advance the end portion into an associated drain pipe.

17. A method of retrofitting an associated existing roof that includes an associated drain bowl that communicates with an associated drain pipe with a drain insert assembly that includes a first, end portion, at least one flange extending outwardly from the end portion, a second portion dimensioned to cover an inner surface of an associated drain bowl, and a seal material interposed between at least the end portion and an associated drain pipe, the method comprising:

providing the seal material around at least the end portion and the at least one flange, including adding seal material between the second portion of the drain insert assembly and an associated inner surface of an associated drain bowl; and inserting the end portion into an associated drain pipe until the second portion is received in an associated drain bowl, including collapsing the at least one flange to release the seal material held therein toward the second portion, and curing the seal material for a preselected time period.

18. The method of claim 17 wherein the end portion inserting step includes deforming the at least one flange between the end portion and the drain pipe.

19. The method of claim 17 wherein the seal material providing step includes adding seal material between the second portion of e drain insert assembly and the inner surface of the drain bowl.

20. The method of claim 19 wherein the end portion inserting step includes collapsing the at least one flange to release the seal material held therein toward the second portion, and curing the seal material for a preselected time period.

* * * * *